US008656871B2

(12) United States Patent
Sato et al.

(10) Patent No.: US 8,656,871 B2
(45) **Date of Patent: *Feb. 25, 2014**

(54) WATER-COOLED FOUR-CYCLE ENGINE

(75) Inventors: Yoshikazu Sato, Wako (JP); Shigeki Edamatsu, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 334 days.

This patent is subject to a terminal disclaimer.

(21) Appl. No.: 13/011,346

(22) Filed: Jan. 21, 2011

(65) Prior Publication Data

US 2011/0192361 A1 Aug. 11, 2011

(30) Foreign Application Priority Data

Feb. 5, 2010 (JP) ..... 2010-023851

(51) Int. Cl.
*F02F 1/10* (2006.01)
*F01P 9/04* (2006.01)

(52) U.S. Cl.
USPC ..... 123/41.72; 123/41.57

(58) Field of Classification Search
USPC ..... 123/41.72, 41.57, 41.82 R
See application file for complete search history.

(56) References Cited

U.S. PATENT DOCUMENTS

| | | | | |
|---|---|---|---|---|
| 4,440,117 | A * | 4/1984 | Buchmuller | 123/41.72 |
| 4,699,100 | A | 10/1987 | Leydorf, Jr. et al. | |
| 4,964,378 | A * | 10/1990 | Tamba et al. | 123/41.57 |
| 4,984,539 | A * | 1/1991 | Shinoda et al. | 123/41.42 |

FOREIGN PATENT DOCUMENTS

| | | | |
|---|---|---|---|
| GB | 1 107 793 | A | 3/1968 |
| GB | 2 150 220 | A | 6/1985 |
| JP | 2-145644 | U | 12/1990 |
| JP | 5-026099 | A | 2/1993 |
| JP | 11-082017 | A | 3/1999 |
| JP | 2009-270442 | A | 11/2009 |

OTHER PUBLICATIONS

European Search Report dated Jun. 10, 2011, issued in corresponding European Patent Application No. 11151724.
Japanese Office Action dated Feb. 22, 2012, issued in corresponding Japanese Patent Application No. 2010-023851.
Office Action dated Sep. 10, 2013, issued in corresponding U.S. Appl. No. 13/011,340. (13 pages).

* cited by examiner

*Primary Examiner* — Lindsay Low
*Assistant Examiner* — Syed O Hasan
(74) *Attorney, Agent, or Firm* — Westerman, Hattori, Daniels & Adrian, LLP

(57) ABSTRACT

In a water-cooled four-cycle engine, an engine core including a cylinder block, a cylinder head and a first crankcase half body is formed as a unitary part cast integrally; a water jacket including a cylinder jacket and a head jacket is formed in the engine core; and a timing-belt chamber being adjacent to the cylinder jacket is provided in a side portion of the engine core. A first opening portion for forming a first semi-peripheral portion of the cylinder jacket on a side opposite from the timing-belt chamber by casting out is provided in a side surface of the cylinder block. Second and third opening portions for forming a second semi-peripheral portion of the cylinder jacket and the head jacket as well as the timing-belt chamber, respectively, by casting out are provided in an upper surface of the cylinder head.

3 Claims, 7 Drawing Sheets

WATER-COOLED FOUR-CYCLE ENGINE

BACKGROUND OF THE INVENTION

1. Field of the Invention

The present invention mainly relates to a general-purpose water-cooled four-cycle engine, and particularly relates to an improvement of a water-cooled four-cycle engine in which: an engine core including a cylinder block, a cylinder head and a first crankcase half body is formed as a unitary part cast integrally, the cylinder block including a cylinder bore, the cylinder head including a combustion chamber as well as an intake port and an exhaust port which are opened to the combustion chamber, the first crankcase half body including a half portion of a crank chamber; an engine main body including the engine core, a second crankcase half body and a head cover, the second crankcase half body including a remaining half portion of the crank chamber and connected to the first crankcase half body, the head cover connected to the cylinder head and defining a valve-operation chamber between the head cover and the cylinder head; a crankshaft housed in the crank chamber is supported by the first and second crankcase half bodies; a camshaft housed in the valve-operation chamber is supported by the cylinder head; a water jacket including a cylinder jacket and a head jacket is formed in the engine core, the cylinder jacket surrounding the cylinder bore, the head jacket communicating with the cylinder jacket and surrounding the combustion chamber; and a timing-belt chamber is provided in a side portion of the engine core, the timing-belt chamber being adjacent to the cylinder jacket across a partition wall integrated with the engine core, the timing-belt chamber housing a timing belt which connects between the crankshaft and the camshaft.

2. Description of the Related Art

Such a water-cooled four-cycle engine is already known, as disclosed in Japanese Patent Application Laid-open No. 5-26099.

The water-cooled four-cycle engine disclosed in Japanese Patent Application Laid-open No. 5-26099 needs as many as three opening portions to form the water jacket by casting out, because: paired opening portions are provided in the respective two side surfaces of the cylinder block in order to form the cylinder jacket around the cylinder by casting out; and the other opening portion is provided in the upper surface of the cylinder head in order to form the head jacket around the combustion chamber by casting out. This makes the structure of the casing dies complicated, and entails higher costs. In addition, the engine needs three lid plates to water-tightly close these opening portions as well. This makes the number of components and the number of assembling steps large. This brings about a disadvantage that not only causes high costs but also makes it difficult to make the engine compact.

SUMMARY OF THE INVENTION

The present invention has been made with this background taken into consideration. An object of the present invention is to provide a water-cooled four-cycle engine which makes two opening portions sufficient to form a water jacket by casting out; accordingly makes two lid plates sufficient to close the two opening portions water-tightly; makes the casting easy; reduces components and assembling steps in number; and can contribute to cost reduction.

In order to achieve the object, according to a first feature of the present invention, there is provided a water-cooled four-cycle engine in which: an engine core including a cylinder block, a cylinder head and a first crankcase half body is formed as a unitary part cast integrally, the cylinder block including a cylinder bore, the cylinder head including a combustion chamber as well as an intake port and an exhaust port which are opened to the combustion chamber, the first crankcase half body including a half portion of a crank chamber; an engine main body includes the engine core, a second crankcase half body and a head cover, the second crankcase half body including a remaining half portion of the crank chamber and connected to the first crankcase half body, the head cover connected to the cylinder head and defining a valve-operation chamber between the head cover and the cylinder head; a crankshaft housed in the crank chamber is supported by the first and second crankcase half bodies; a camshaft housed in the valve-operation chamber is supported by the cylinder head; a water jacket including a cylinder jacket and a head jacket is formed in the engine core, the cylinder jacket surrounding the cylinder bore, the head jacket communicating with the cylinder jacket and surrounding the combustion chamber; and a timing-belt chamber is provided in a side portion of the engine core, the timing-belt chamber being adjacent to the cylinder jacket across a partition wall integrated with the engine core, the timing-belt chamber housing a timing belt which connects between the crankshaft and the camshaft, wherein a first opening portion is provided in a side surface of the cylinder block, the first opening portion used to form a first semi-peripheral portion of the cylinder jacket on a side opposite from the timing-belt chamber by casting out, a second opening portion and a third opening portion are provided in an upper surface of the cylinder head, the second opening portion used to form a second semi-peripheral portion of the cylinder jacket and the head jacket communicating with the cylinder jacket by casting out, the third opening portion used to form the timing-belt chamber by casting out, and first and second lid plates for water-tightly closing the first and second opening portions are connected to the cylinder block and the cylinder head, respectively.

According to the first feature of the present invention, the cylinder jacket, the head jacket and the timing-belt chamber can be easily formed by casting out in the two directions which are orthogonal to each other. This not only makes it easy to cast the engine core including the cylinder jacket, the head jacket and the timing-belt chamber, but also makes two lid plates, namely, the first and second lid plates sufficient to water-tightly close the first and second opening portions. Accordingly, the number of component parts and the number of assembling steps are smaller than otherwise. This can contribute to cost reduction.

According to a second feature of the present invention, in addition to the first feature, spaces respectively entering opposite side portions of the partition wall are provided between the cylinder block and the timing-belt chamber.

According to the second feature of the present invention, the existence of the spaces entering the opposite side portions of the partition wall enlarges the heat radiation surfaces of the peripheral walls of the cylinder block and the timing-belt chamber. This can help to cool the cylinder block and the timing-belt chamber. In addition, the weight of the engine core can be reduced.

The above description, other objects, characteristics and advantages of the present invention will be clear from detailed descriptions which will be provided for the preferred embodiment referring to the attached drawings.

DESCRIPTION OF THE PREFERRED EMBODIMENT

Figure 1:
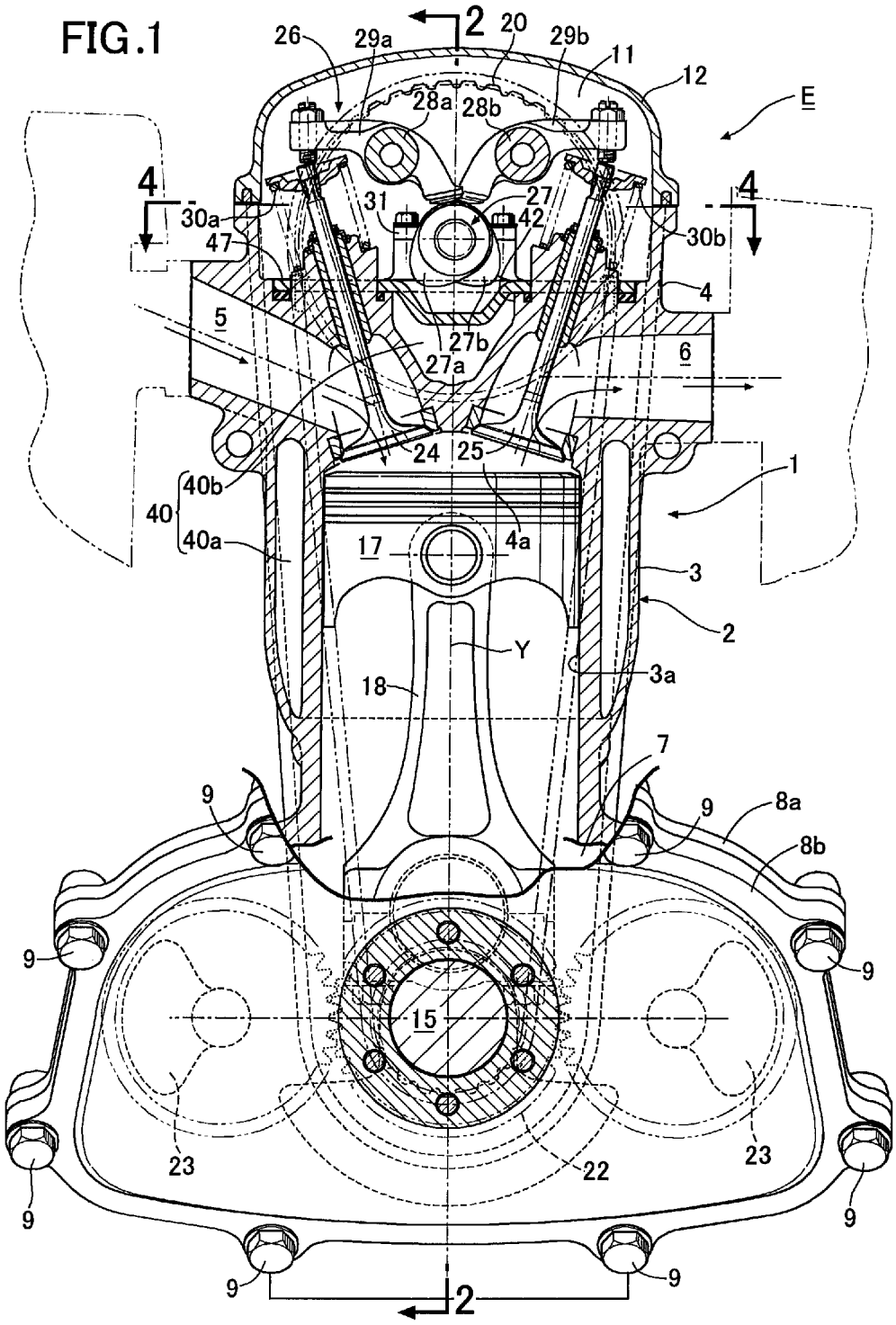
FIG. 1 is a longitudinal cross-sectional elevation view of a water-cooled four-cycle engine according to an embodiment of the present invention.

An embodiment of the present invention will be described below based on the attached drawings.

In FIGS. 1 to 4, an engine main body 1 of a water-cooled four-cycle engine E includes an engine core 2. This engine core 2 constitutes a unitary part obtained by integrally molding a cylinder block 3, a cylinder head 4 and a first crankcase half body 8*a* by die-casting. The cylinder block 3 includes a cylinder bore 3*a*. The cylinder head 4 includes: a combustion chamber 4*a* communicating with the cylinder bore 3*a*; and an intake port 5 and an exhaust port 6 which are opened to the combustion chamber 4*a*. The first crankcase half body 8*a* includes one half of a crank chamber 7. The engine main body 1 is formed of the engine core 2, a second crankcase half body 8*b* and a head cover 12. The second crankcase half body 8*b* includes the other half of the crank chamber 7, and is connected to the first crankcase half body 8*a* by use of multiple bolts 9. The head cover 12 is connected to the cylinder head 4 by use of multiple bolts 10. A valve-operation chamber 11 is defined between the head cover 12 and the cylinder head 4.

A timing-belt chamber 13 which communicates with the crank chamber 7 and the valve-operation chamber 11 is formed in one side portion of the engine core 2.

When connected together, the first and second crankcase half bodies 8*a*, 8*b* constitute the crankcase. Connection surfaces 14 (see FIG. 2) of the respective first and second crankcase half bodies 8*a*, 8*b* are formed inclined obliquely to an axis Y of the cylinder bore 3*a*. A crankshaft 15 housed in the crank chamber 7 is pivotally supported by the first and second crankcase half bodies 8*a*, 8*b* with ball bearings 16, 16 interposed in between. The crankshaft 15 is connected to a piston 17 with a connecting rod 18 interposed in between. The piston 17 is slidably fitted in the cylinder bore 3*a*. A toothed driving pulley 19 facing the timing-belt chamber 13 is fixedly provided to the crankshaft 15.

In addition, paired primary balancers 23, 23 placed on two sides of the crankshaft 15, respectively are housed in the crank chamber 7. A driving gear 22 on the crankshaft 15 drives the primary balancers 23, 23 in their respective directions, which are opposite to each other, at the same rotational speed as the crankshaft 15 rotates. This prevents the primary inertial vibration of the engine E.

An intake valve 24 for opening and closing the intake port 5 and an exhaust valve 25 for opening and closing the exhaust port 6 are provided in the cylinder head 4. A valve operating mechanism 26 for opening and closing the intake valve 24 and the exhaust valve 25 is housed in the valve-operation chamber 11.

The valve operating mechanism 26 includes: a camshaft 27; intake and exhaust rocker shafts 28*a*, 28*b*; intake and exhaust rocker arms 29*a*, 29*b*; and valve springs 30*a*, 30*b*. The camshaft 27 includes intake and exhaust cams 27*a*, 27*b*, as well as is rotatably supported by the cylinder head 4 in parallel with the crankshaft 15. The intake and exhaust rocker shafts 28*a*, 28*b* are supported by the head cover 12 in parallel with this camshaft 27. The intake rocker arm 29*a* is swingably supported by the intake rocker shaft 28*a*, as well as connects the intake cam 27*a* and the intake valve 24 together. The exhaust rocker arm 29*b* is swingably supported by the exhaust rocker shaft 28*b*, as well as connects the exhaust cam 27*b* and the exhaust valve 25 together. The valve springs 30*a*, 30*b* bias the intake and exhaust valves 24, 25 in their closing directions, respectively.

The camshaft 27 is supported by paired bearing portions 31, 32 which are respectively provided to a second lid plate 47 and the cylinder head 4 across the timing-belt chamber 13, although the second lid plate 47 will be described later. A toothed follower pulley 20 which is arranged between these bearing portions 31, 32 and which faces the timing-belt chamber 13 is fixedly provided to the camshaft 27. A toothed timing belt 21 wound around this follower pulley 20 and the driving pulley 19 is placed in the timing-belt chamber 13. The number of teeth provided to the follower pulley 20 is twice as many as the number of teeth provided to the driving pulley 19. Thus, the rotation of the driving pulley 19 is transmitted to the camshaft 27 in a way that the rotational speed of the follower pulley 20 is equal to half the rotational speed of the driving pulley 19.

Figure 2:
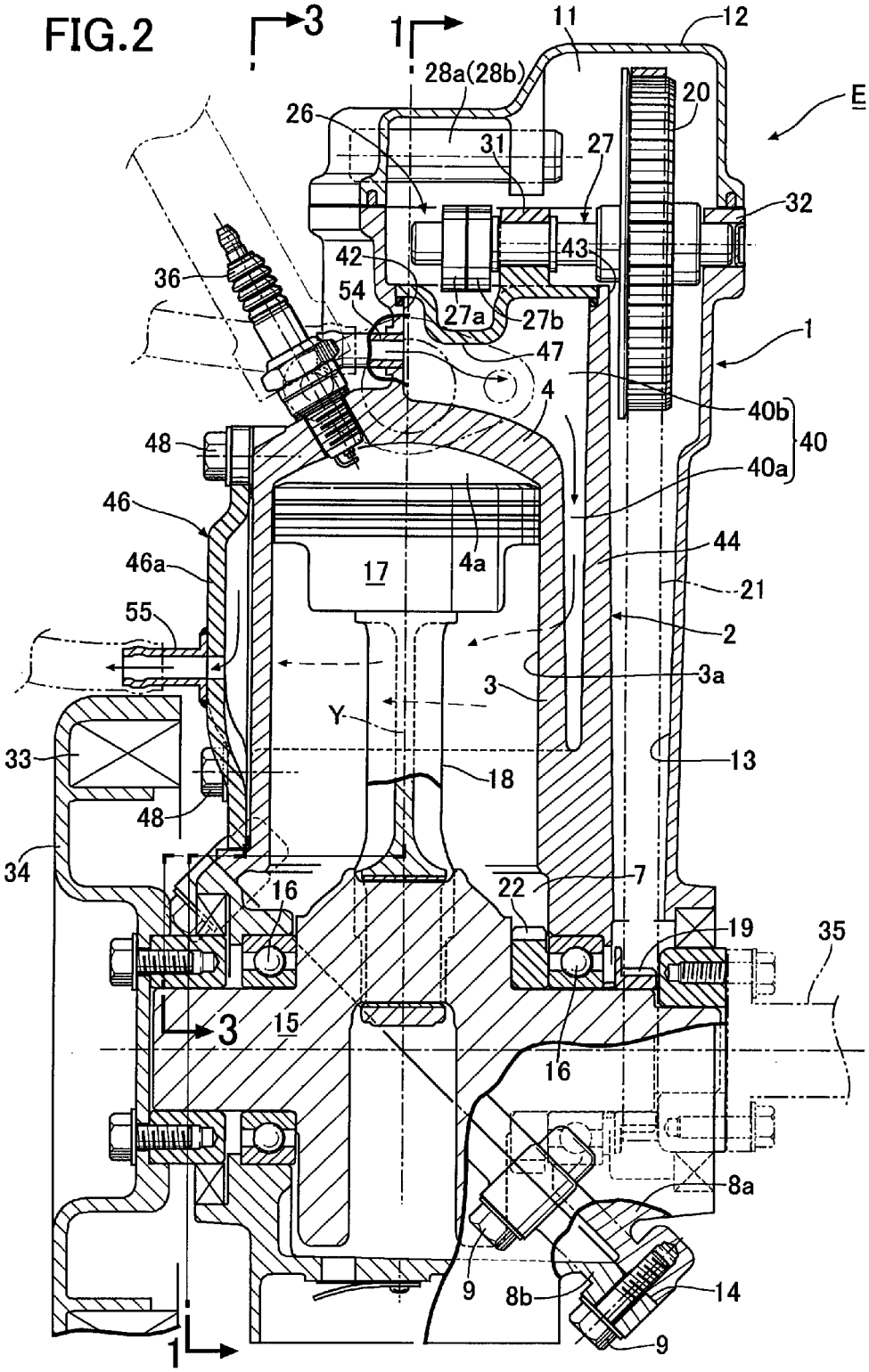
FIG. 2 is a sectional view taken along a line 2-2 in FIG. 1.
Figure 3:
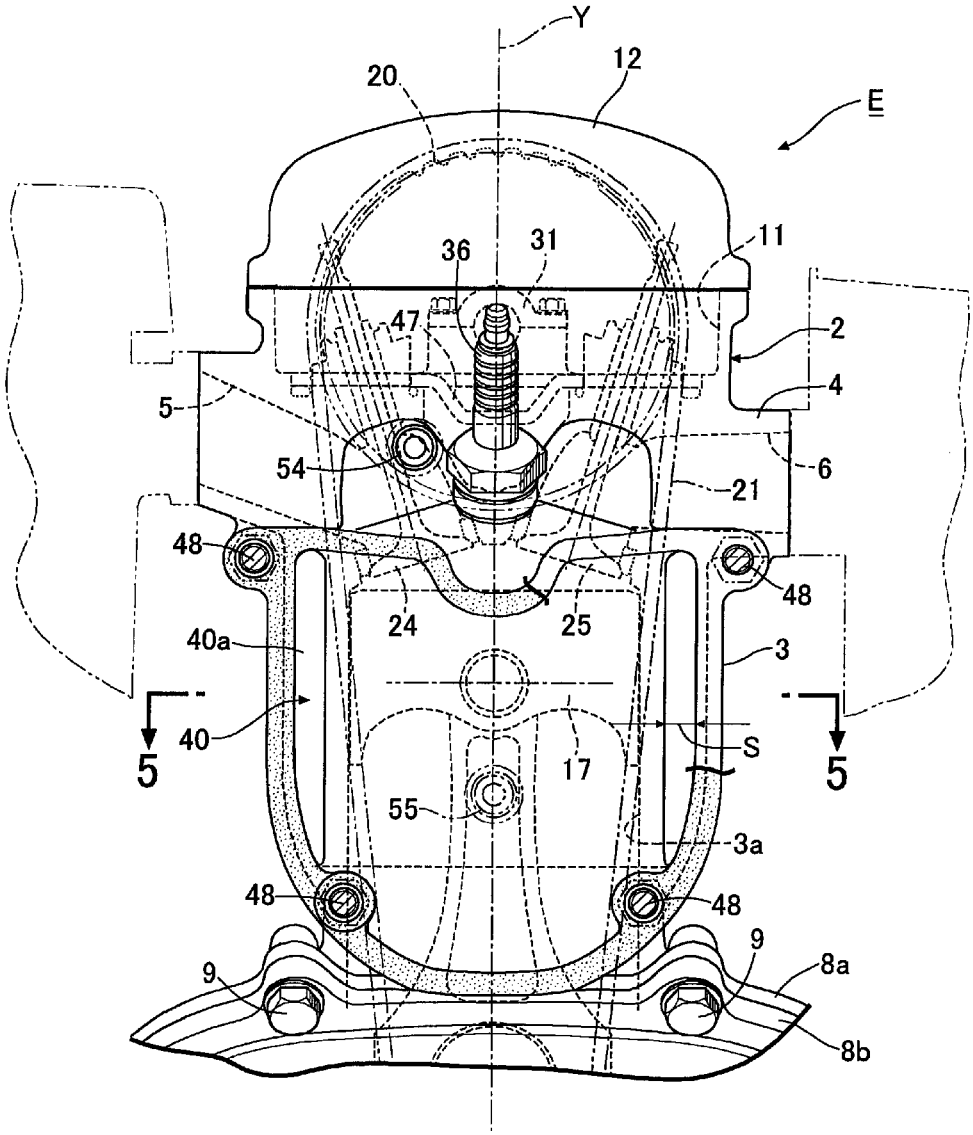
FIG. 3 is a sectional view taken along a line 3-3 in FIG. 2.
Figure 4:
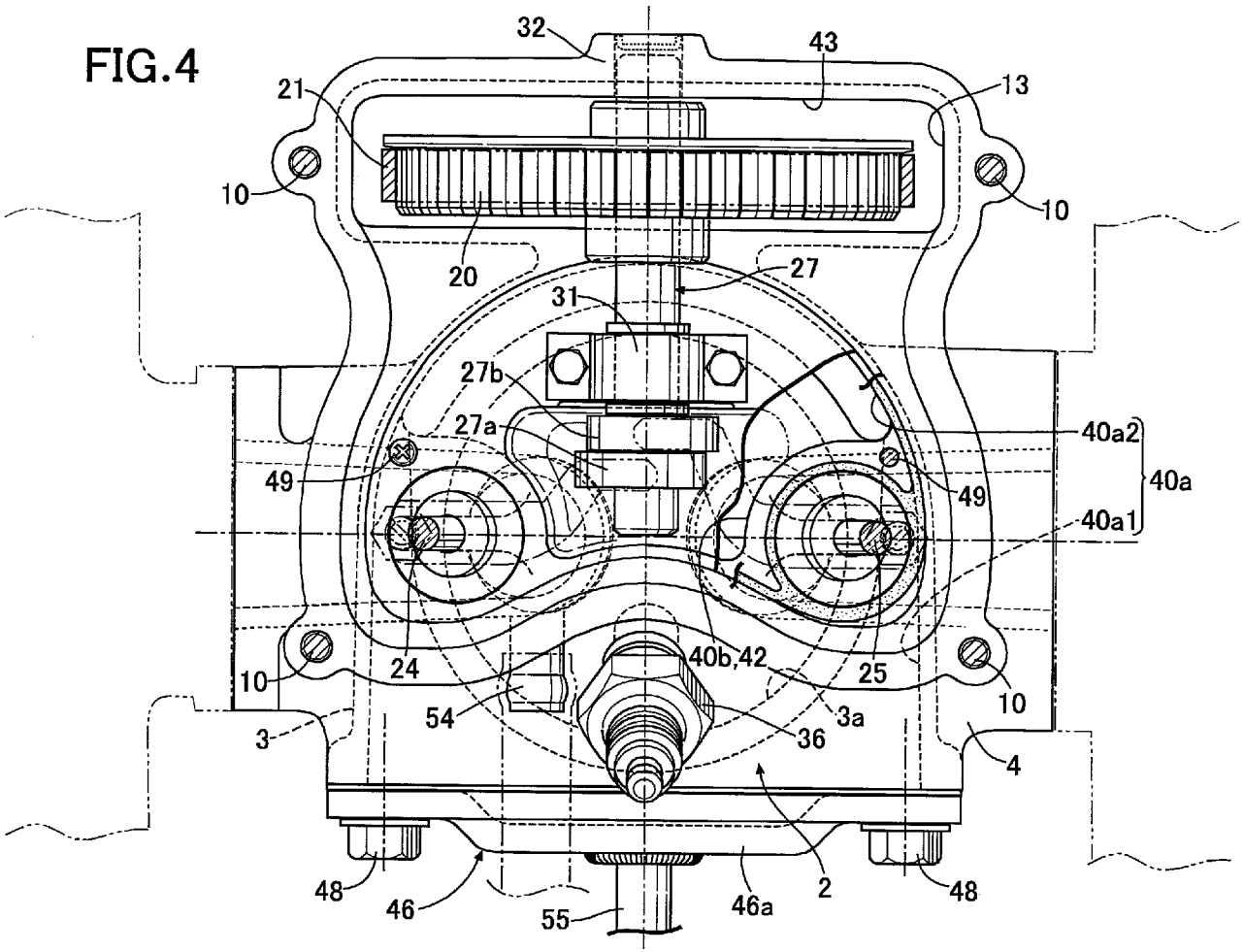
FIG. 4 is a sectional view taken along a line 4-4 in FIG. 1.
Figure 5:
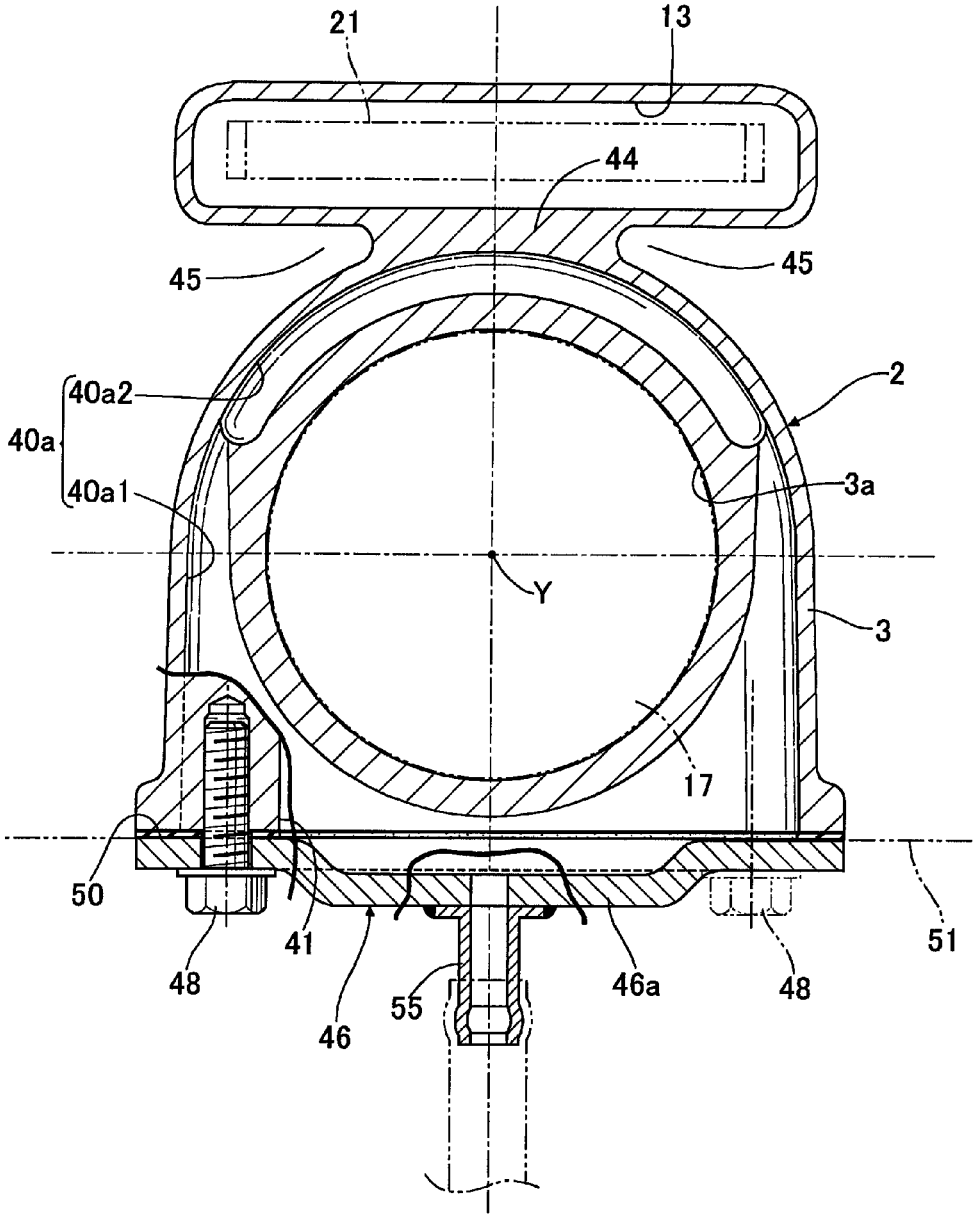
FIG. 5 is a sectional view taken along a line 5-5 in FIG. 3.

As shown in FIG. 2, a flywheel 34 including a magneto coil 33 is fixedly provided to an end portion of the crankshaft 15, while an output shaft 35 for driving various working units (not illustrated) is connected to the other end portion of the crankshaft 15.

In addition, an ignition plug 36 is screwed to the cylinder head 4 on a side opposite to the timing-belt chamber 13 across the axis Y of the cylinder bore 3*a*. The ignition plug 36 faces its electrode to the combustion chamber 4*a*.

As shown in FIGS. 1 to 5, a water jacket 40 is formed in the engine core 2. This water jacket 40 includes: a cylinder jacket 40*a* surrounding the cylinder bore 3*a*; and a head jacket 40*b* communicating with the cylinder jacket 40*a*, and surrounding the combustion chamber 4*a*, the intake port 5 and the exhaust port 6. A first opening portion 41 which is used to form a first semi-peripheral portion 40*a*1 of the cylinder jacket 40*a* by casting out is provided to one side surface of the cylinder block 3. The first semi-peripheral portion 40*a*1 is situated on the opposite side from the timing-belt chamber 13. In addition, a second opening portion 42 and a third opening portion 43 are provided in the upper surface of the cylinder head 4. The second opening portion 42 is used to form a second semi-peripheral portion 40*a*2 of the cylinder jacket 40*a* and the head jacket 40*b* communicating with the cylinder jacket 40*a* by casting out. The third opening portion 43 is used to form the timing-belt chamber 13 by casting out.

The second semi-peripheral portion 40*a*2 of the cylinder jacket 40*a* is adjacent to the timing-belt chamber 13 across a partition wall 44 integrated with the cylinder block 3. A semi-peripheral portion of an outer peripheral surface of the cylinder block 3, which is closer to the timing-belt chamber 13, is formed of a semicylinder-shape. Spaces 45, 45 entering the respective two side portions of the partition wall 44 are provided between the cylinder block 3 and the timing-belt chamber 13. By this, heat radiating surfaces in the peripheral walls of the cylinder block 3 and the timing-belt chamber 13 are expanded by the spaces 45, 45 which enter the respective two side portions of the partition wall 44. This expansion can facilitate the cooling of the cylinder block 3 and the timing-belt chamber 13, and helps to reduce the weight of the engine core 2.

The first opening portion 41 is water-tightly closed by a first lid plate 46 which is connected to the side surface of the cylinder block 3 by use of multiple bolts 48. The second opening portion 42 is water-tightly closed by the second lid plate 47 which is connected to the upper surface of the cylinder head 4 by use of multiple bolts 49.

Connection surfaces 50, respectively, of the first lid plate 46 and the cylinder block 3 are placed on a plane 51 which is parallel with the axis Y of the cylinder bore 3*a*, and which is on or near an outer side surface of a peripheral wall of the cylinder bore 3*a*. A swollen portion 46*a* swollen out in a direction away from the outer side surface of the peripheral wall is formed in the first lid plate 46.

Figure 6:
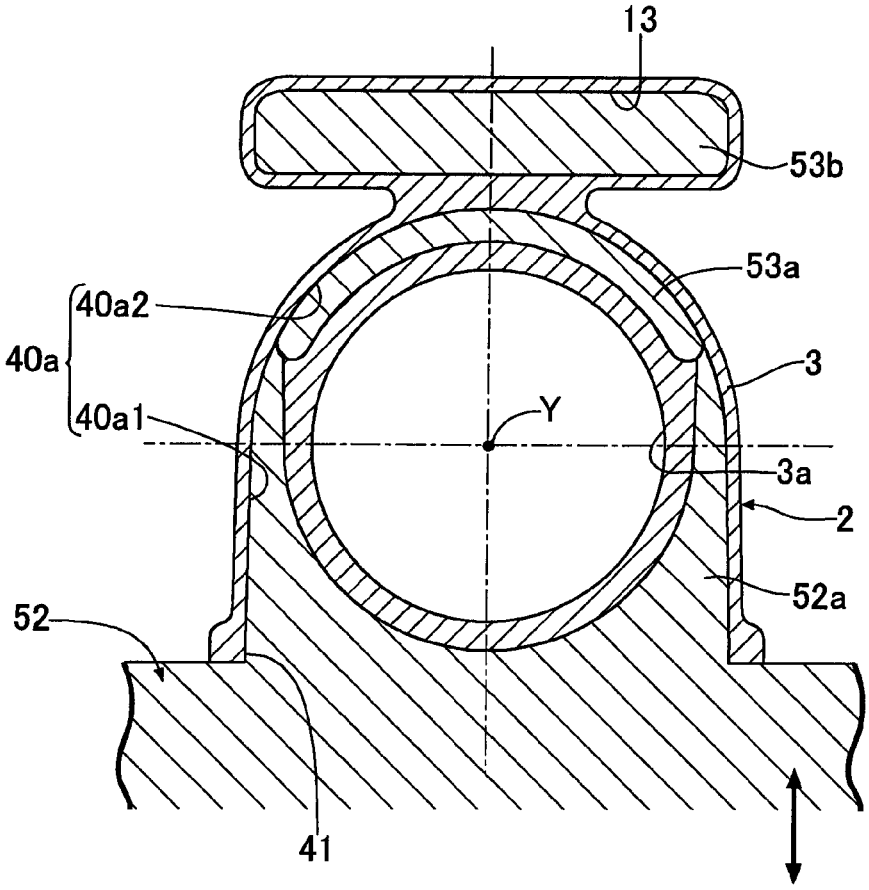
FIG. 6 is a cross-sectional view of an engine core showing a method for forming a water jacket and a timing-belt chamber.
Figure 7:
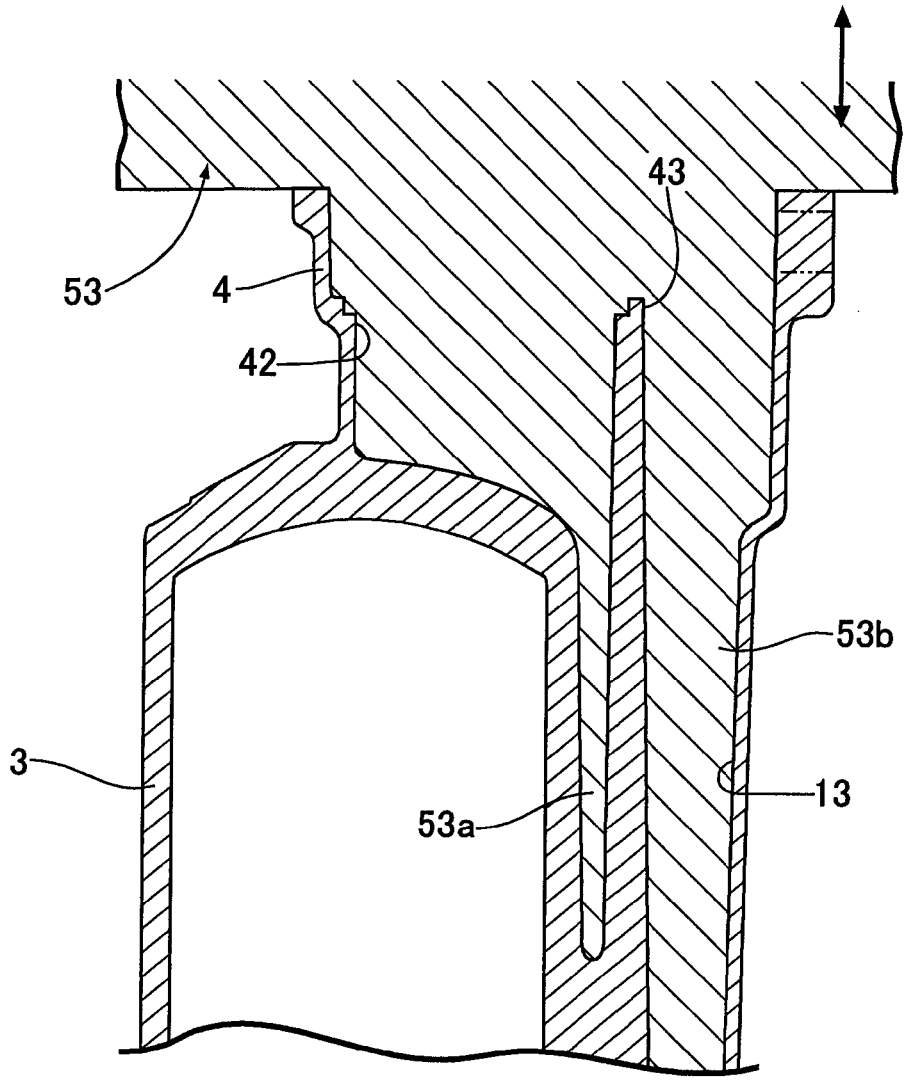
FIG. 7 is a longitudinal cross-sectional view of the engine core showing the method forming the same.

FIGS. 6 and 7 show multiple cores which are used to die-cast the engine core 2, particularly, to form the water jacket 40 and the timing-belt chamber 13. A first core 52*a* used to form the first semi-peripheral portion 40*a*1 of the cylinder jacket 40 is provided to a first die 52 which is configured to advance or retreat in an opening direction of the first opening portion 41, in other words, in a radial direction of the cylinder bore 3*a*. Second and third cores 53*a*, 53*b* used to form the head jacket 40*b* and cylinder jacket 40*a*, respectively, are provided to a second die 53 which is configured to advance and retreat in opening directions of the respective second and third opening portions 42, 43, in other words, in a direction of the axis Y of the cylinder bore 3*a*. Dies used to form the other components of the engine core 2 are omitted from the illustrations.

For this reason, when a liquefied material is injected and filled into the cavities in the dies which are clamped together with the first to third cores 52*a*, 53*a*, 53*b* set up in their respective advancement positions, the engine core 2 including the water jacket 40 and the timing-belt chamber 13 can be cast. After this casting, the first to third cores 52*a*, 53*a*, 53*b* are retreated out of the first to third opening portions 41 to 43, respectively. In this manner, the cylinder jacket 40*a*, the head jacket 40*b* and the timing-belt chamber 13 can be easily formed by use of the first to third cores 52*a*, 53*a*, 53*b* which are configured to advance and retreat in the directions orthogonal to each other.

During this casting, the cylinder jacket 40*a* is formed in a way that the thickness S (see FIG. 3) of the lower portion of the cylinder jacket 40*a* diminishes toward the first crankcase half body 8*a*.

In FIG. 2, the cylinder head 4 is provided with an inlet pipe 54 which is opened toward an upper portion of the head jacket 40*b*. In addition, the first lid plate 46 is provided with an outlet pipe 55 which is opened toward a lower portion of the cylinder jacket 40*a*. Cooling water cooled by a radiator (not illustrated) is supplied to the upper portion of the head jacket 40*b* through the inlet pipe 54, and cools the peripheries of the intake and exhaust ports 5, 6 while flowing in the head jacket 40*b* from the upper portion to the lower portion. Subsequently, the cooling water flows into the cylinder jacket 40*a*, and cools the periphery of the cylinder bore 3*a* while flowing from the upper to lower portions of the cylinder jacket 40*a*. Thereafter, the cooling water flows out through the outlet pipe 55, and returns to the radiator.

Next, descriptions will be provided for operations of the embodiment.

While the engine E is in operation, as described above, the cooling water flows sequentially in the head jacket 40*b* around the intake and exhaust ports 5, 6, as well as the cylinder jacket 40*a* around the cylinder bore 3*a*. Thereby, the engine core 2 can be efficiently cooled from a high-temperature portion near the combustion chamber 4*a* through a low-temperature portion in the lower portion of the cylinder bore 3*a*. Furthermore, it is possible to prevent a lower portion around the cylinder bore 3*a* from being cooled excessively by the cooling water, and thus to enhance the combustion efficiency of the engine E, because the cylinder jacket 40*a* around the cylinder bore 3*a* is formed in a way that the thickness S of the lower portion of the cylinder jacket 40*a* diminishes toward the first crankcase half body 8*a*.

Moreover, the first opening portion 41 used to form the first semi-peripheral portion 40*a*1 of the cylinder jacket 40*a* on the opposite side from the timing-belt chamber 13 by casting out is provided in the one side surface of the cylinder block 3. In addition, the second opening portion 42, which is used to form the second semi-peripheral portion 40*a*2 of the cylinder jacket 40*a* and the head jacket 40*b* communicating with the cylinder jacket 40*a* by casting out, and the third opening portion 43, which is used to form the timing-belt chamber 13 by casting out, are provided in the upper surface of the cylinder head 4. For this reason, the cylinder jacket 40*a*, the head jacket 40*b* and the timing-belt chamber 13 can be formed by casting out in the only two directions orthogonal to each other. This not only makes it easy to cast the engine core 2 including the cylinder jacket 40*a*, the head jacket 40*b* and the timing-belt chamber 13, but also makes two lid plates, namely, the first and second lid plates 46, 47 sufficient to close the first and second opening portions 41, 42 water-tightly. Accordingly, it is possible to reduce components and assembling steps in number. This can contribute to cost reduction.

Furthermore, the connection surfaces 50, respectively, of the first lid plate 46 and the cylinder block 3 are placed on the plane 51 which is parallel with the axis Y of the cylinder bore 3*a*, and which is on or near the outer side surface of the peripheral wall of the cylinder bore 3*a*. Additionally, the swollen portion 46*a* swollen out in the direction away from the outer side surface of the peripheral wall is formed in the first lid plate 46. For this reason, it is possible to make the engine core 2 compact by making the connection surfaces 50, respectively, of the first lid plate 46 and the cylinder block 3 closer to the cylinder bore 3*a* as much as possible, and to secure the necessary volume of the cylinder jacket 40*a* by use of the swollen portion 46*a* of the first lid plate 46.

The present invention is not limited to the foregoing embodiment. Various design changes can be made for the present invention within the scope not departing from the gist of the present invention. For example, the crankshaft 15 may be held between the two crankcase half bodies 8*a*, 8*b* by placing the connection surfaces of the respective first and second crankcase half bodies 8*a*, 8*b* on a plane including the axis of the crankshaft 15.

What is claimed is:

1. A water-cooled four-cycle engine, comprising:

an engine core including a cylinder block, a cylinder head and a first crankcase half body formed as a unitary part cast integrally, the cylinder block including a cylinder bore, the cylinder head including a combustion chamber, an intake port and an exhaust port, the intake port and the exhaust port being opened to the combustion chamber, the first crankcase half body forming a first half portion of a crank chamber;

a second crankcase half body forming a second half portion of the crank chamber and connected to the first crankcase half body;

a head cover connected to the cylinder head and defining a valve-operation chamber between the head cover and the cylinder head;

a crankshaft housed in the crank chamber and supported by the first and second crankcase half bodies; and a camshaft housed in the valve-operation chamber and supported by the cylinder head;

wherein a water jacket including a cylinder jacket and a head jacket is formed in the engine core, the cylinder jacket surrounding the cylinder bore, the head jacket communicating with the cylinder jacket and surrounding the combustion chamber;

wherein a timing-belt chamber is provided in a side portion of the engine core, the timing-belt chamber being adjacent to the cylinder jacket across a partition wall integrated with the engine core, the timing-belt chamber housing a timing belt which connects between the crankshaft and the camshaft, wherein a first opening portion is provided in a side surface of the cylinder block, the first opening portion forming a first semi-peripheral portion of the cylinder jacket on a side of the cylinder block opposite from the timing-belt chamber, wherein a second opening portion and a third opening portion are provided in an upper surface of the cylinder head, the second opening portion forming a second semi-peripheral portion of the cylinder jacket and the head jacket, the third opening portion forming the timing-belt chamber by casting out, and wherein first and second lid plates for water-tightly closing the first and second opening portions are connected to the cylinder block and the cylinder head, respectively, and wherein the second lid plate is disposed between the head cover and the cylinder head.

2. The water-cooled four-cycle engine according to claim 1, wherein said engine core is configured such that, as viewed along an axis of said cylinder bore, an outer surface of said engine core tapers inward at a position between said cylinder block and said timing-belt chamber, so as to form spaces between the outer surface of a portion of said engine core corresponding to said cylinder block and the outer surface of a portion of said engine core corresponding to said timing-belt chamber, on opposite sides of said partition wall.

3. The water-cooled four-cycle engine according to claim 1, wherein said second lid plate is disposed below said camshaft.

* * * * *